United States Patent [19]

Gurevich

[11] 4,435,639

[45] Mar. 6, 1984

[54] ELECTRICAL DEVICES WITH WATER-BLOCKING INSULATION

[75] Inventor: Boris Gurevich, Mountain View, Calif.

[73] Assignee: Raychem Corporation, Menlo Park, Calif.

[21] Appl. No.: 418,354

[22] Filed: Sep. 15, 1982

[51] Int. Cl.[3] ..... H05B 3/56

[52] U.S. Cl. ..... 219/544; 174/22 C; 174/23 R; 219/528; 219/553; 338/22 R; 338/214

[58] Field of Search ..... 219/504, 528, 535, 544, 219/549, 553; 174/22 R, 22 C, 23 R, 23 C; 338/22 R, 22 SD, 214

[56] References Cited

U.S. PATENT DOCUMENTS

| | | | |
|---|---|---|---|
| 3,657,520 | 4/1972 | Ragault | 219/553 |
| 3,691,505 | 9/1972 | Graves | 338/214 |
| 4,242,573 | 12/1980 | Butliwalla | 219/528 |
| 4,288,144 | 9/1981 | Nakai et al. | 174/23 R X |

FOREIGN PATENT DOCUMENTS

| | | | |
|---|---|---|---|
| 2808438 | 9/1979 | Fed. Rep. of Germany | 174/23 C |

*Primary Examiner*—Volodymyr Y. Mayewsky
*Attorney, Agent, or Firm*—Timothy H. P. Richardson

[57] ABSTRACT

Permeation of water between inner and outer insulating jackets of an elongate electrical heater or other device along a metallic braid between the jackets is limited by means of a water-blocking section. The water-blocking section is generally placed near the connected end of the device to prevent water from reaching the connection. In the water-blocking section, the outer jacket is removed and an insulating sleeve, preferably a heat-shrunk polymeric sleeve, is placed over the exposed length of the inner jacket and the ends of the outer jacket. A water-proof sealing material is placed between the sleeve and part only of the exposed inner jacket. In this way, water which permeates between the jackets to the water-blocking section is prevented from passing through the section but is permitted to escape from the device.

7 Claims, 2 Drawing Figures

ELECTRICAL DEVICES WITH WATER-BLOCKING INSULATION

BACKGROUND OF THE INVENTION

1. Field of the Invention

This invention relates to elongate electrical devices comprising two spaced-apart insulating jackets and means for limiting the damage which can result from water permeating along the device between the jackets, e.g., along a metallic braid between the jackets.

2. Introduction to the Invention

Elongate electrical devices of many kinds, in particular heaters and sensors, have been described in prior publications and in co-pending, commonly assigned, patent applications. Particularly useful are self-regulating heaters which comprise two or more elongate electrodes having a plurality of heating elements connected in parallel with each other between the electrodes; for example, heaters comprising two or more electrodes embedded in a PTC conductive polymer element are commercially available and give excellent results. Other heaters comprise a resistive heating element composed of a metal. Reference may be made for example to U.S. Pat. No. 4,242,573.

Many elongate electrical devices comprise inner and outer insulating jackets which are spaced apart from each other, typically by a metallic braid which provides an electrical shield as well as added resistance to physical abuse. A disadvantage of this type of device is that if water enters the space between the jackets, e.g., as a result of damage to the outer jacket, the water can wick down the heater between the jackets. This can occur as a result of capillary action even when there is no hydrostatic pressure. If the water reaches either end of the device, there is a risk that the device will malfunction, e.g., by shorting the two (or more) electrodes of a parallel heater. So long as the water does not reach either end of the device, it does not usually have any adverse effect on the performance of the device because the inner jacket excludes the water from the electrically active part of the device.

SUMMARY OF THE INVENTION

I have now discovered that the risk of malfunction can be substantially reduced by providing the device with at least one water-blocking section through which water cannot wick and from which water can escape from the space between the insulating jackets to the exterior of the device.

In one aspect, the invention provides an elongate electrical device which comprises (a) an electrical element;

(b) an inner insulating jacket surrounding the electrical element; and (c) an outer insulating jacket surrounding but spaced apart from the inner jacket so that water entering the space between the jackets can wick along the device between the jackets, the device comprising, at at least one point along its length, a water-blocking section in which the outer jacket has been removed to provide an exposed length of the inner jacket, said water-blocking section comprising (d) an insulating sleeve which surrounds the exposed length of the inner jacket and the ends of the outer insulating jacket, and (e) a sealing material which provides a water-proof seal between the sleeve and part only of the exposed length of the inner jacket.

BRIEF DESCRIPTION OF THE DRAWING

The invention is illustrated in the accompanying drawing in which.

DETAILED DESCRIPTION OF THE INVENTION

Since the purpose of the water-blocking section or sections is usually to prevent water from reaching one or both ends of the device, the water-blocking section is preferably located near one end of the device, with the sealing material providing a waterproof seal not only between the sleeve and part of the exposed length of inner jacket, but also between the sleeve and the end of the outer jacket which is nearer the adjacent end of the device.

Suitable sealing materials are known in the art. Hot melt adhesives are preferred. The sealing material can be applied to the device (after removing a length of the outer jacket) before the sleeve is applied. Alternatively the sealing material and sleeve can be applied simultaneously by means of a sleeve having part of its inner surface covered with sealing material. It is important that the sealing material cover part only of the exposed inner jacket, so that water wicking along the device can escape from the water-blocking section.

The sleeve is preferably one which is applied by shrinking a shrinkable, preferably heat-shrinkable, polymeric member around the water-blocking section. The sleeve can be a generally tubular member of closed cross section which is slipped over the end of the device or a wrap-around sleeve having the two edges secured to each other in any suitable way.

Figure 1:
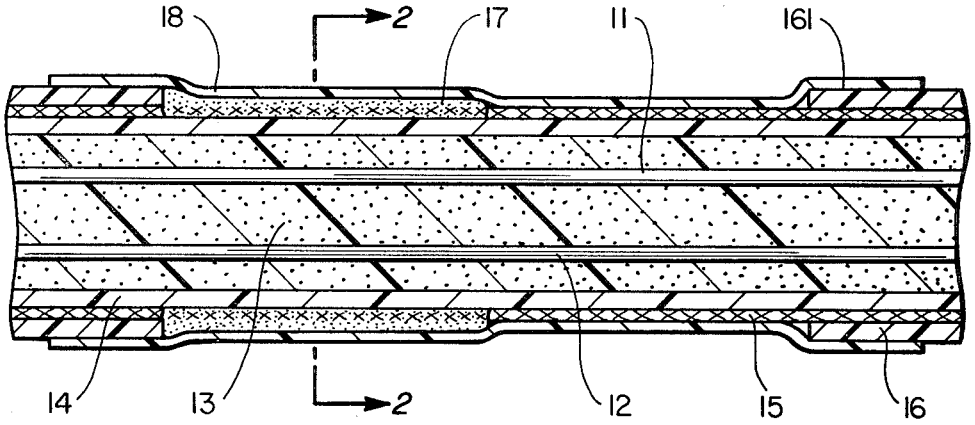
FIG. 1 is a longitudinal cross-section through a heater according to the invention.
Figure 2:
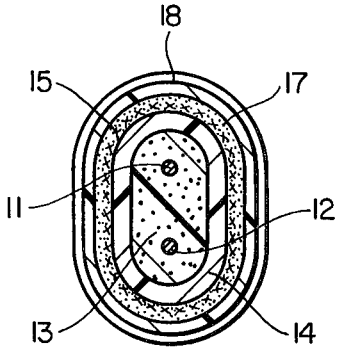
FIG. 2 is a transverse cross-section on the line 2—2 of FIG. 1.

Refer now to the drawing, FIGS. 1 and 2 show the water-blocking section of a self-regulating heater which comprises two electrodes 11 and 12 embedded in a PTC conductive polymer strip 13 which is surrounded in turn by an inner insulating jacket 14, a metallic braid 15 and an outer insulating jacket 16. In the water-blocking section a length of the outer jacket 16 has been removed and part of the axial length of exposed metal braid has been impregnated around its entire cross-section with a hot melt adhesive 17 which provides a waterproof seal between the inner jacket and an outer sleeve 18 which has been heat-shrunk around the heater. When water wicks up the metallic braid from the right hand end of the heater, it cannot pass through the water-blocking section to the left hand end of the heater, but can escape from the heater between the sleeve and the end 161 of the outer jacket.

I claim:

1. An elongated heater which comprises:

(a) an elongate electrical heating element;

(b) an inner waterproof electrically insulating jacket surrounding the electrical element; and (c) an outer waterproof electrically insulating jacket surrounding but spaced apart from the inner jacket so that water entering the space between the jackets can wick along the heater between the jackets, the heater comprising, at at least one intermediate point along its length, a water-blocking section through which the electrical element and the inner jacket pass without interruption but in which the outer jacket has been removed to provide an exposed length of the inner jacket, said water-blocking section further comprising (d) a waterproof electrically insulating sleeve which surrounds the exposed length of the inner jacket and the ends of the outer insulating jacket, and (e) a sealing material which secures the sleeve around the inner and outer jackets and provides a waterproof seal between the sleeve and around part only of the exposed length of the inner jacket.

2. The heater according to claim 1 wherein the water-blocking section is near one end of the device and the sealing material provides a waterproof seal between between the sleeve and the end of the outer jacket which is near said end of the device.

3. The heater according to claim 1 wherein said heating element comprises a resistive heating element composed of a conductive polymer composition.

4. The heater according to claim 3 wherein the conductive polymer composition exhibits PTC behavior.

5. The heater according to claim 4 which comprises at least two electrodes embedded in the heating element.

6. The heater according to claim 1 which comprises a metallic braid between the inner and outer jackets.

7. The heater according to claim 1 wherein the insulating sleeve is a heat-shrunk tube and the sealing material is a hot melt adhesive.

* * * * *